US005390637A

United States Patent [19]

Yoshioka et al.

[11] Patent Number: 5,390,637

[45] Date of Patent: Feb. 21, 1995

[54] ENGINE SPEED CONTROLLER FOR A VEHICLE

[75] Inventors: Mamoru Yoshioka; Kunihiko Nakata, both of Susono, Japan

[73] Assignee: Toyota Jidosha Kabushiki Kaisha, Aichi, Japan

[21] Appl. No.: 120,822

[22] Filed: Sep. 15, 1993

[30] Foreign Application Priority Data

Oct. 1, 1992 [JP] Japan ..... 4-263922

[51] Int. Cl.[6] ..... F02D 41/14; F02D 41/22

[52] U.S. Cl. ..... 123/333; 123/350

[58] Field of Search ..... 123/332, 333, 350, 351, 123/352, 357, 198 DB

[56] References Cited

U.S. PATENT DOCUMENTS

| | | | |
|---|---|---|---|
| 4,506,638 | 3/1985 | Horii et al. | 123/333 |
| 4,674,458 | 6/1987 | Mori | 123/333 |
| 4,736,719 | 4/1988 | Francia et al. | 123/333 |
| 4,930,594 | 6/1990 | Kosizawa | 123/333 |
| 4,977,876 | 12/1990 | Nanyoshi et al. | 123/333 |
| 4,998,519 | 3/1991 | Kobayashi | 123/333 |

FOREIGN PATENT DOCUMENTS 1-118142 8/1989 Japan .

*Primary Examiner*—E. Rollins Cross
*Assistant Examiner*—Thomas Moulis
*Attorney, Agent, or Firm*—Oliff & Berridge

[57] ABSTRACT

A vehicular engine speed controller for keeping the engine speed constant while preventing the overrunning of the engine. The vehicle includes a propeller shaft connected to driving wheels and a torsional damper for connecting the propeller shaft with the engine drive shaft. The controller comprises a detector for detecting a value corresponding to engine speed, and an injection control device for controlling injectors, based on the detected value from the detector. The control device stores a first and second determining values (Da and Db). The control device halts fuel supply from the injector when the detected value exceeds the first value (Da), and resumes fuel supply when the detected value becomes below the second value (Db). The control device further causes the injector to execute the resumption and halt of fuel injection at least one time, when the detected value is changed to a smaller value than the first value (Da) from a larger value than the first value (Da), thereby extinguishing the torsional energy accumulated in the torsional member. The engine speed is not affected by the torsional damper.

11 Claims, 11 Drawing Sheets

ENGINE SPEED CONTROLLER FOR A VEHICLE

BACKGROUND OF THE INVENTION

1. Field of the Invention

The present invention relates generally to a control apparatus for controlling the number of revolutions of an engine mounted on a vehicle. More particularly, the present invention relates to a control apparatus which enables a fuel-cut operation when the engine is running at a high speed, so as to prevent the engine from revolving excessively (i.e., overrunning).

2. Description of the Related Art

In general, a compulsive halt operation of fuel injection through injectors (i.e., fuel cut-off operation) is carried out to prevent the engine from revolving excessively, when the vehicular engine is running at a high speed. An engine speed sensor disposed in the engine continuously monitors the engine speed (NE) thereof, and transmits a detection signal to an engine speed controller. The controller includes memories which store a first determining value (Da) for use in determining timing of the halt operation of the fuel injection and a second determining value (Db), which is smaller than the first determining value (Da), for use in determining timing to resume the fuel injection. The controller comparers the first and second determining values with the engine speed (NE) detected by means of the engine speed sensor.

When the engine speed (NE) exceeds the first determining value (Da) for fuel injection halt, the controller carries out the fuel cut-off operation. When the engine speed (NE) drops below the second determining value (Db) for fuel injection resume, the controller resumes the fuel supplying operation. There is a width (i.e., hysteresis) between the first determining value (Da) and the second determining value (Db). The controller repeatedly carries out the operation to drop the engine speed due to the fuel cut-off and the operation to rise the engine speed due to the resumption of fuel supply. Consequently, the engine speed (NE) can be maintained in a range between the first and second determining values (Da and Db) to prevent the engine from overrunning, through the repeated execution of the above-mentioned operations. However, this traditional technique causes the engine speed (NE) to fluctuate largely between the first and second determining values (Da and Db), when the engine is running at a high speed. This large fluctuation of the engine speed lets a driver feel discomfort for driving a vehicle.

Japanese Unexamined Utility Model Publication No. 1-118142 discloses the technology which can minimize the fluctuation of the engine speed. According to the publication, the first and second determining values (Da and Db) are gradually decreased with the hysteresis therebetween being kept constant, while a predetermined period of time has elapsed since the engine speed reached a high speed level. As a result, the engine speed (NE) gradually decreases while it repeatedly fluctuates within the range between the determining values Da and Db.

However, everyone of the above-described conventional technologies generate small delay period of time $\Delta t$ (i.e., time lag) which corresponds to the duration of the controller from reading the engine speed thereof to transmitting halt/resume instructional signal for fuel injection. This time lag is originated in the operational time of the controller or the cycle time of interrupt operation. Therefore, a small time lag is generated until the fuel cut-off operation is actually carried out since the engine speed exceeded the first determining value (Da) and until the fuel injection is actually resumed since the engine speed dropped below the second determining value (Db). The engine speed either continuously increases during the period of the time lag and overshoots the first determining value (Da), or continuously drops during the period of the time lag and then reaches below the second determining value (Db).

An ordinary vehicle includes a plurality of torsional dampers which are disposed between a drive shaft of the engine and a propeller shaft connected by drive wheels. The torsional dampers prevent the engine power caused by an acceleration or deceleration of the vehicle from being directly transmitted via the propeller shaft to the drive wheels. In other words, the dampers relieve the sudden fluctuation of the engine power. Further, the torsional dampers allow the drive shaft to displace or shift with respect to the propeller shaft, along an accelerating or decelerating direction of the driving wheels, due to self-swerve. Therefore, the dampers efficiently relieve the impact originated in the acceleration or deceleration.

The torsional dampers accumulate deformation energy or repulsion force generated by the swerve thereof when the speed of the driving wheels are accelerated or decelerated. Therefore, when the operation is reversed between the acceleration and deceleration operations, the torsional dampers not only dissolve the swerve but also assist the revolution of the engine drive shaft by the action of the accumulated deformation energy. As a result, the torsional dampers promote the engine speed to overshoot.

The fluctuation phenomena of the engine speed caused by the torsional dampers will now be described referring to FIGS. 11 and 12. FIG. 11 is a schematic view showing the relative position between an engine drive shaft 52 (i.e., a crank shaft) and a propeller shaft 51 connected to the drive wheels. FIG. 12 is diagram showing the correlation between the time and the engine speed (NE), condition of fuel cut-off and displacement of the engine drive shaft 52.

The propeller shaft 51 and drive shaft 52 rotate in the clockwise direction in FIG. 11. When the vehicle is not running or is running at a constant cruising speed, the drive shaft 52 is located at a neutral position in FIG. 11. In the neutral position, the torsional dampers are in the natural condition without swerving. A first maximum displaced position (PA) in FIG. 11 indicates the relative position of the drive shaft 52 with respect to the propeller shaft 51, when the torsional dampers are swerved (or twisted) within the maximum capacity thereof along the regular direction of the revolution of the drive shaft 51, in accordance with an engine acceleration. A second maximum displaced position (PB) indicates the relative position of the drive shaft 52 with respect to the propeller shaft 51, when the torsional dampers are swerved within the maximum capacity thereof along the reverse direction of the revolution of the drive shaft 51, in accordance with an engine deceleration.

When the engine is under the acceleration at timing t21 which is indicated in FIG. 12, the engine speed (NE) is thus increasing. The positive torque is applied on the torsional dampers, due to the acceleration. Consequently, the torsional dampers are swerved, and the drive shaft 52 is held at the first maximum displaced position (PA). In this case, the torsional dampers accumulate the repulsion force which causes the drive shaft 52 to return to the neutral position. This repulsion force acts to restrain the revolution of the drive shaft 52.

At timing t22 of FIG. 12, the engine speed (NE) exceeds the first determining value (Da) for the fuel injection halt. At timing t23 when the delay time Δt has elapsed since the timing t22, the controller transmits a signal to instruct the fuel cut-off operation. In the period of time (timing t22 through timing t23), the engine speed continuously increases.

When the fuel supply to the engine is cut off, the positive torque applied to the torsional dampers up to this point will be inverted to the negative torque. As a result, the drive shaft 52 shifts its position from the first maximum displaced position (PA) to the second maximum displaced position (PB). At the same time, the engine speed (NE) rapidly drops, that is caused by the repulsion force accumulated in the torsional dampers, in addition to the engine power drop originated in the fuel cut-off.

When the drive shaft 52 is at the second maximum displaced position (PB), the torsional dampers accumulate the repulsion force which acts on the drive shaft 52 to return to the neutral position. The repulsion force promotes the revolution of the drive shaft 52.

At timing t24 in FIG. 12, the engine speed (NE) drops below the second determining value (Db) for fuel injection resume. At timing t25 when the delay time Δt has elapsed since the timing t24, the controller transmits a signal to instruct to resume the fuel injection operation. During the period of time (between timings t24 and t25), the engine speed (NE) continuously decreases.

When the fuel injection operation is resumed, the negative torque applied on the torsional dampers up to this point is inverted to the positive torque. As a result, the drive shaft 52 shifts its position from the second maximum displaced position (PB) to the first maximum displaced position (PA). In this case, the engine speed (NE) rapidly increases, that is caused by the repulsion force accumulated in the torsional dampers, in addition to the rapid increase of the engine power which is generated by the resumption of fuel injection. In this manner, the controller repeatedly alternately carries out the halt and resume of the fuel injection operations.

The fluctuation of the engine speed (NE) per an unit time in the period of time after timing t23 is larger than that in the period of time before timing t23 (i.e., until the first fuel cut-off operation was carried out). Because, the engine speed is influenced by the repulsion force accumulated in the torsional dampers, after the first fuel cut-off operation was carried out. Therefore, even if the delay time Δt is kept constant, the amount of overshoot of the engine speed is gradually increased. As a result, the fluctuation of the engine speed will not be reduced, under the fuel cut-off control.

SUMMARY OF THE INVENTION

Accordingly, it is a primary objective of the present invention to provide an improved engine speed controller which can perform the fuel cut-off control operation to prevent an engine drive shaft from being positioned at the maximum displaced position with respect to a propeller shaft. According to the improved controller, the engine speed is not largely influenced by the repulsion force accumulated in the torsional members such as torsional dampers. Consequently, the fluctuation of the engine speed is reduced or minimized, under the fuel cut-off control operation.

To achieve the foregoing and other objects and in accordance with the present invention, an improved engine speed controller for a vehicle is provided. The vehicle includes an engine with a drive shaft; an injector for supplying fuel to the engine; a driving wheel; a propeller shaft connected to the driving wheel; and a flexible torsional member for connecting the propeller shaft with the engine drive shaft to relieve a torque impact caused by engine acceleration or deceleration.

The engine speed controller includes a detector and an injection control device. The detector detects a value corresponding to engine speed, and outputs the detected value to the injection control device. The injection control device controls the injector, based on the detected value from the detector, such that the engine speed is kept constant while preventing overrunning of the engine. The injection control device includes a data storage unit for storing a first determining value (Da) for the halt of fuel injection, and a second determining value (Db) for the resumption of fuel injection. The injection control device further includes a primary and secondary control units.

The primary control unit halts fuel supply from the injector when the detected value exceeds the first determining value (Da), and resumes fuel supply from the injector when the detected value becomes below the second determining value (Db). The secondary control unit causes the injector to execute the resumption and halt of fuel injection at least one time, when the detected value is changed to a smaller value than the first value (Da) from a larger value than the first value (Da). Such operation extinguishes the torsional energy accumulated in the torsional member.

It is preferable that the data storage unit further stores a third determining value (Dc) set between the first and second determining values (Da and Db). In this case, the secondary control unit causes the injector to execute the resumption and halt of fuel injection at least one time, when the detected value is changed to a smaller value than the third value (Dc) from a larger value than the first value (Da). This manner has an additional advantage as described in the following second and third embodiments.

BRIEF DESCRIPTION OF THE DRAWINGS

The feature of the present invention that are believed to be novel are set forth with particularity in the appended claims. The invention, together objects and advantages thereof, may best be understood by reference to the following description of the presently preferred embodiments together with the accompanying drawings.

FIGS. 1 through 6 show a first embodiment according to the present invention, in which:

FIG. 1 is a schematic view showing drive wheels, power train, engine and engine speed controller;

FIG. 3 is a block diagram showing the electric construction of the engine speed controller including a CPU;

FIG. 4 is a flowchart showing a routine for the fuel cut-off control operation which is carried out by the CPU;

FIG. 6 is a graph showing the correlation between an exhaust air-fuel ratio and the temperature of catalyst.

FIGS. 7 and 8 show a second embodiment according to the present invention, in which:

FIG. 7 is a flowchart showing a routine for the fuel cutoff control operation which is carried out by the CPU.

FIGS. 9 and 10 show a third embodiment according to the present invention, in which:

FIG. 9 is a flowchart showing a routine for the fuel cutoff control operation which is carried out by the CPU.

DETAILED DESCRIPTION OF THE PREFERRED EMBODIMENTS

The first through third embodiments according to the present invention will now be described referring to the accompanying drawings.

First Embodiment

Figure 1:
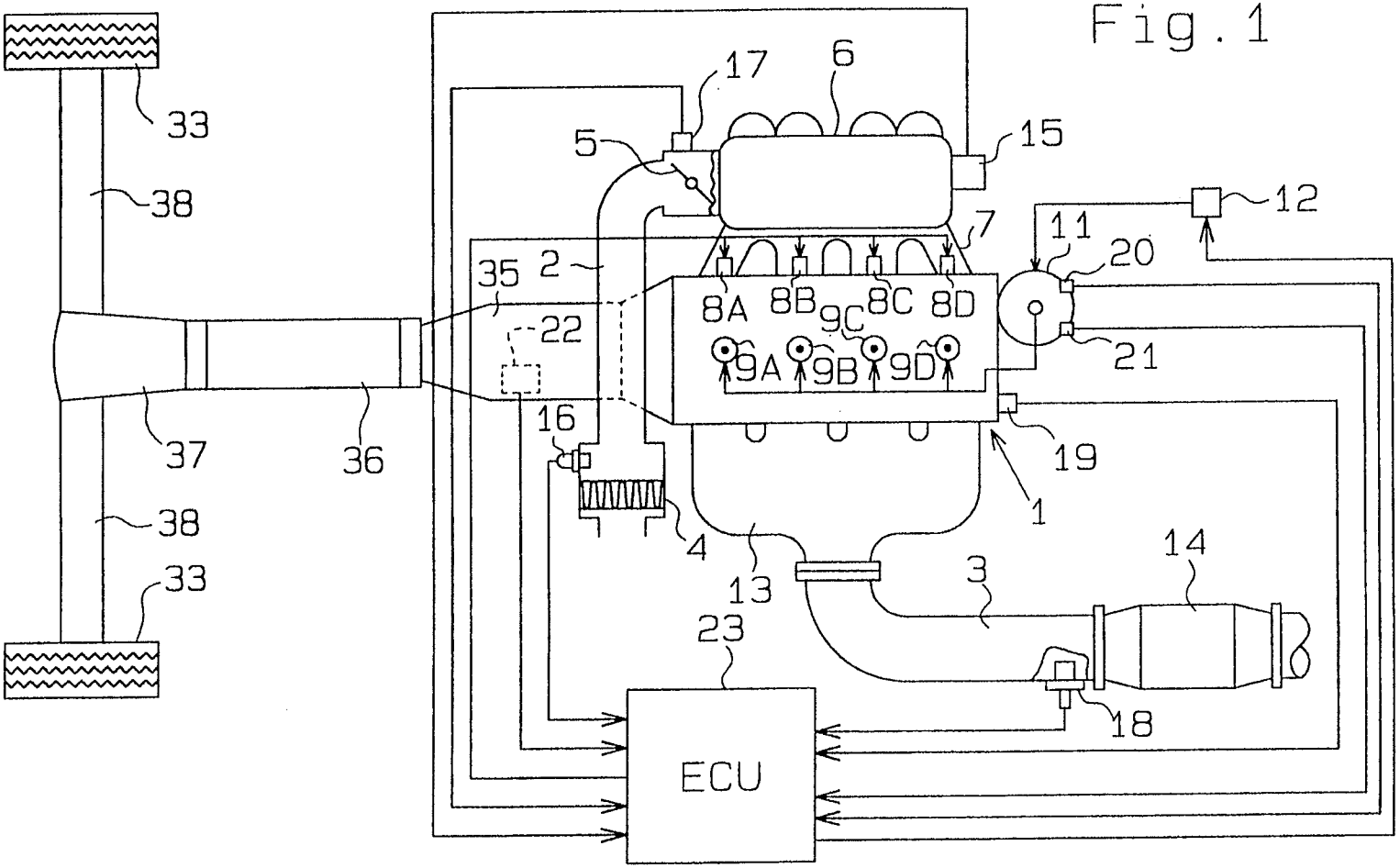

As shown in FIG. 1, a gasoline engine 1 is mounted in a vehicle. The engine 1 includes a plurality of cylinders (four cylinders in this embodiment), each of the cylinders including a combustion chamber (not shown). These combustion chambers communicate with an air intake passage 2 and exhaust passage 3. An air cleaner 4, throttle valve 5, surge tank 6 and intake manifold tubes 7 are disposed along the air intake passage 2. The fresh air is taken into the engine 1 through the air intake passage 2. An opening angle of the throttle valve 5 is altered in accordance with the thrust amount of an accelerator pedal (not shown), so as to adjust the throughput of air to the engine 1. The surge tank 6 weakens the pulsation of intake air.

The intake manifold tubes 7 are provided with a plurality of injectors 8A, 8B, 8C and 8D, respectively. Each of the injectors supply fuel to the corresponding cylinder. The mixture of fuel from the injector with the air from the intake passage is guided to the respective combustion chamber. The engine 1 includes a plurality of ignition plugs 9A, 9B, 9C and 9D which correspond to the cylinders, respectively. The ignition plugs 9A through 9D are ignited by a respective ignition signal transmitted from a distributor 11. The distributor 11 distributes high voltage generated by means of an igniter 12 to the ignition plugs 9A through 9D, synchronously with the crank angle of the engine 1. The air/fuel mixtures in the combustion chambers are explosively burnt by ignition of the plugs 9A through 9D, respectively, so as to generate the drive power of the engine 1.

The burnt gas is discharged from the combustion chambers to the outside through the exhaust passage 3. Exhaust manifold tubes 13 and a catalytic converter 14 are disposed along the exhaust passage 3. The catalytic converter 14 purifies the exhaust gas which includes hydric carbon (HC), carbon monoxide (CO) and nitrogen oxides (NOx).

The vehicle includes a pair of driving wheels 33. A drive shaft (i.e., a crank shaft) of the engine 1 is connected to a transmission 35, via a clutch 34. Further, the transmission 35 is operably connected to the driving wheels 33, via a propeller shaft 36, differential gear 37, and a pair of wheel drive shafts 38.

Figure 2A:
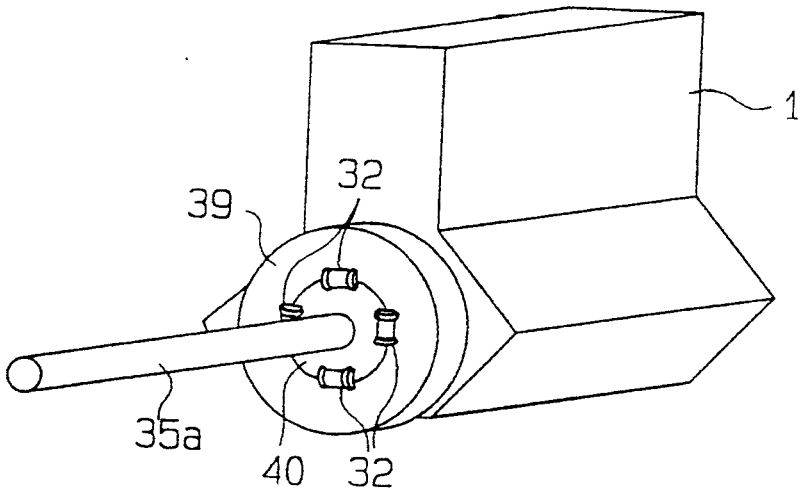
FIGS. 2A, 2B and 2C are schematic perspective views of the engine and torsional dampers fitted to the engine.
Figure 2C:
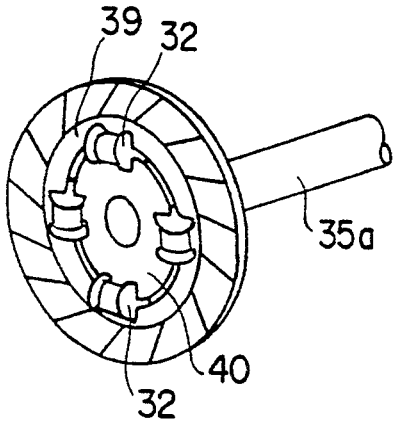
Figure 2B:
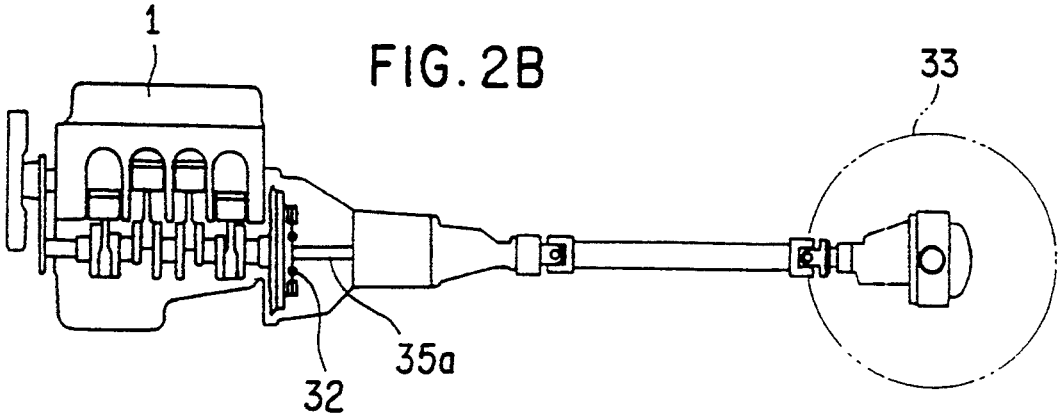

As shown in FIGS. 2A, 2B and 2C, a ring-shaped crank plate 39 is mounted on the engine drive shaft. The crank plate 39 rotates integrally with the engine drive shaft. A ring-shaped transmission plate 40 is mounted on a shaft 35*a* of the transmission 35. The transmission plate 40 rotates integrally with the transmission shaft 35*a*. The transmission plate 40 is disposed within the crank plate 39, in such a manner that it is slidable along the engine drive shaft and rotatable over the engine drive shaft. The plates 39 and 40 are connected with each other, by means of a plurality of torsional dampers 32 (four dampers in this embodiment). These torsional dampers 32 are made of rubber, and are swerveable or flexible to some extent. Each of the torsional dampers 32 allows the engine drive shaft to be shifted or displaced along the direction of the acceleration or deceleration of the driving wheels 33, thereby efficiently relieving the impact originated in the increase or decrease of the engine speed.

An engine system of the vehicle includes several sensors 15 through 22 which detect various conditions of the engine 1. An inlet air pressure sensor 15 is fitted in the surge tank 6 to detect the inlet air pressure (PM) (absolute pressure). An inlet air temperature sensor 16 is disposed in the casing for the air cleaner 4 to detect the inlet air temperature (THA). A throttle sensor 17 is disposed in the vicinity of the throttle valve 5 to detect the opening angle (TA) of the throttle valve 5. An oxygen sensor 18 is disposed between the exhaust manifold tubes 13 and the catalytic converter 14 to detect the oxygen density in the exhaust gas, that is air-fuel ratio (A/F) in the exhaust passage 3 (hereinafter referred to as "exhaust air-fuel ratio").

A coolant temperature sensor 19 is fitted in a water outlet housing of the engine 1 to detect the coolant temperature (THW) of the engine 1. The engine speed sensor 20 detects the engine speed (NE) which is counted by a unit of r.p.m. (revolution per minute), based on the revolving speed of a rotor (not shown) disposed within the distributor 11. A timing sensor 21 detects crank angles of the engine 1 by a predetermined interval, according to the revolving speed of the rotor disposed in the distributor 11. A vehicle speed sensor 22 is disposed within the transmission 35 to detect the vehicle speed (SPD). The vehicle speed (SPD) has the correlativity with the engine speed (NE).

Figure 3:
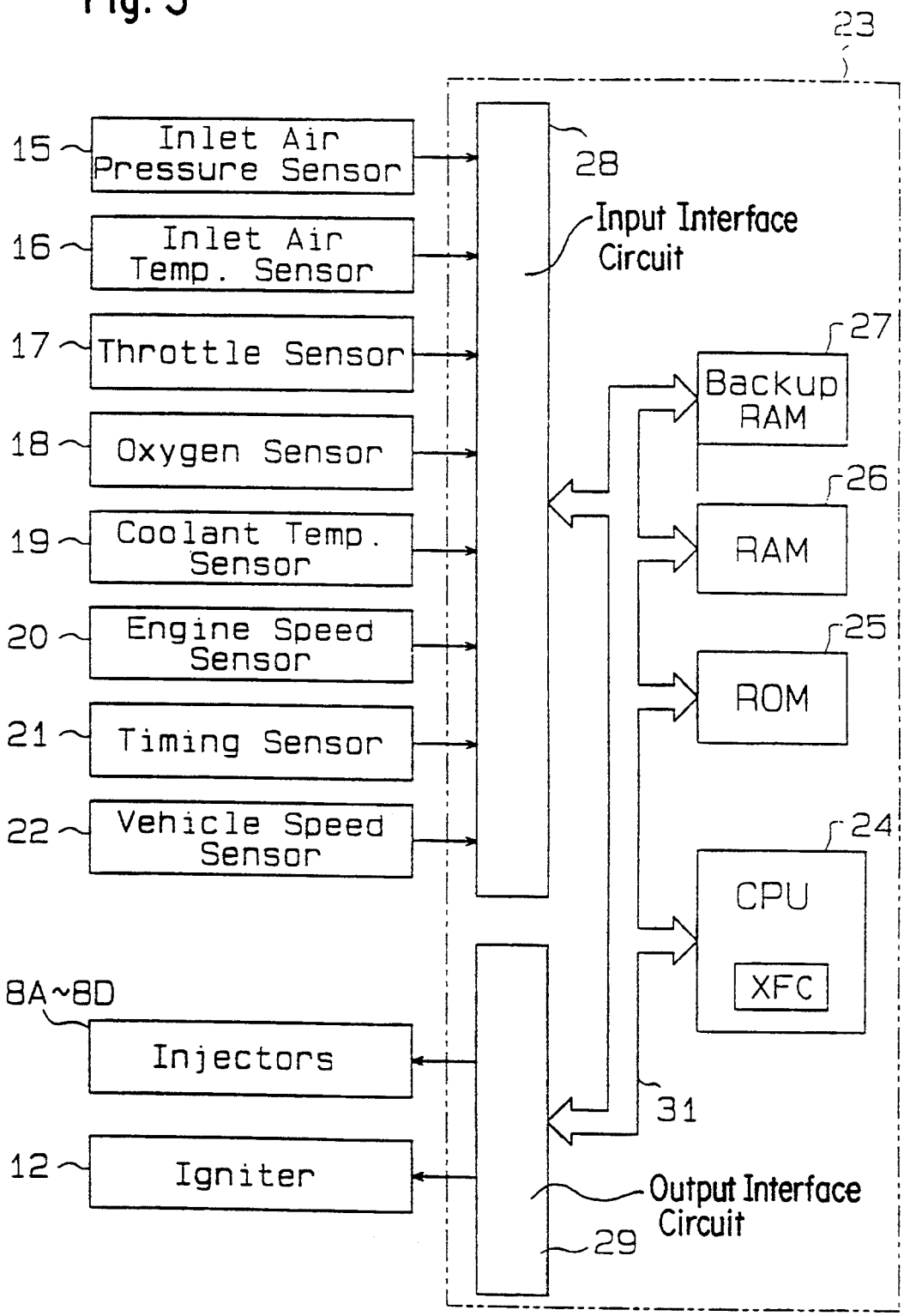

The engine system further includes an electronic control unit (ECU) 23. As shown in FIG. 3, the ECU 23 includes a central processing unit (CPU) 24, read only memory (ROM) 25, random access memory (RAM) 26, backup RAM 27, input interface circuit 28, output interface circuit 29 and data buses 31, which mutually interconnect with the above-described components. The CPU 24 carries out various operations according to control programs. The ROM 25 stores the control programs and initial data which are required for the CPU 24 to operate. The RAM 26 temporarily stores the operational results from the CPU 24. The backup RAM 27 is continuously backuped by a battery, so as to reserve the various data even after the power is cut off.

The output interface circuit 29 of the ECU 23 is connected to the injectors 8A through 8D and the igniter 12. The input interface circuit 28 of the ECU 23 is connected to the inlet air pressure sensor 15, inlet air temperature sensor 16, throttle sensor 17, oxygen sensor 18, coolant temperature sensor 19, engine speed sensor 20, timing sensor 21 and vehicle speed sensor 22.

The CPU 24 reads the signals (i.e., detected data) transmitted from the respective sensors 15 through 22, via the input interface circuit 28. The CPU 24 controls the injectors 8A through 8D and igniter 12 on the basis of the detected data. Described in more detail, the CPU 24 computes the engine speed (NE), inlet air pressure (PM), inlet air temperature (THA), coolant temperature (THW) and oxygen density in the exhaust gas. Further, the CPU 24 computes a target value of fuel injection based on the above computed values. The CPU 24 transmits instructional signals, which indicate the valve opening period of time corresponding to the target value of fuel injection, to the injectors 8A through 8D, respectively.

Figure 4:
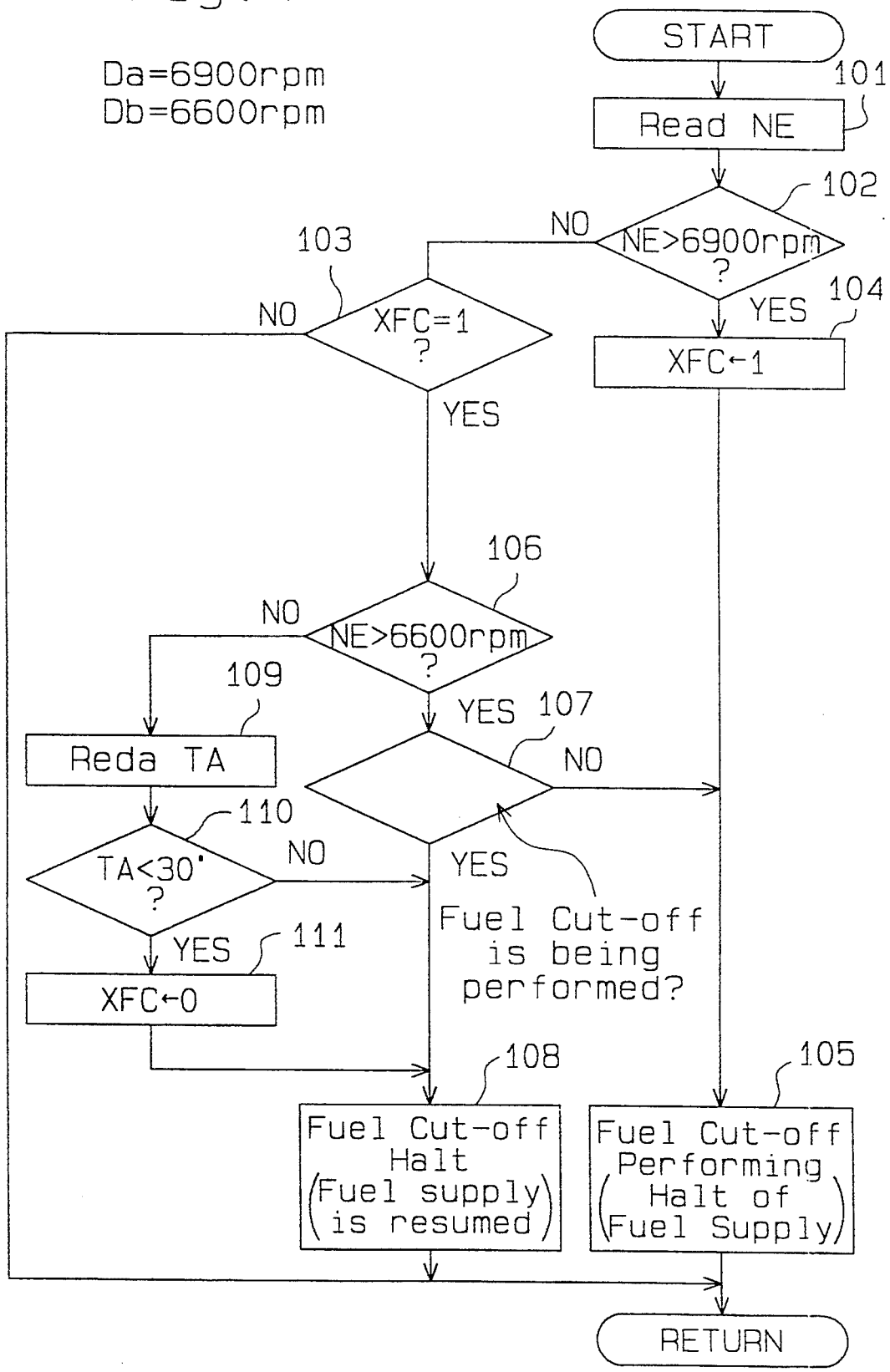

The operations in this embodiment will now be described referring to FIGS. 4 and 5A, 5B, 5C and 5D. The flowchart in FIG. 4 shows a routine for the fuel cut-off control operation which is carried out by the CPU 24. The operations according to this routine are initiated by the interrupt request which is periodically generated every a predetermined time interval (e.g., sixteen milliseconds).

The ROM 25 stores two determining values beforehand, which are used in this routine. The first determining value (Da) is called the injection halt determining value, that indicates the engine speed which the fuel injection should be halted. The second determining value (Db) is called the injection resume determining value, that indicates the engine speed which the fuel injection should be resumed. According to this embodiment, the first value (Da) is set to 6900 r.p.m., and the second value (Db) is set to 6600 r.p.m.

A flag (XFC) is provided for the operations according to the routine in FIG. 4. In this embodiment, a part of an internal counter or accumulator of the CPU 24 is assigned to as the flag (XFC). The flag (XFC) is set to "0", when the actual engine speed (NE) is equal to or below the second determining value (Db) and the throttle angle (TA) is less than a predetermined angle (i.e., 30° in this embodiment). The flag (XFC) is set to "1", when the actual engine speed (NE) exceeds the first determining value (Da). In other words, the flag (XFC) is used as an indicator for carrying out the fuel cut-off operation.

For example, at timing t1 in FIGS. 5A, 5B, 5C and 5D, the engine speed (NE) is below the second determining value (Db), while the engine speed (NE) is increasing by thrusting an acceleration pedal. When the operation described in FIG. 4 is initiated at timing t1, the flag (XFC) has already been set to "0".

At first, the CPU 24 reads the current engine speed (NE) detected by the engine speed sensor 20 (step 101). The CPU 24 determines whether or not the current engine speed (NE) exceeds the first determining value (Da) (i.e., 6900 rpm) (step 102). At timing t1, since the engine speed (NE) is below the determining value (Da), the CPU 24 determines NO at step 102. Thereafter, the CPU 24 determines whether the flag (XFC) is "1" or not (step 103). Since the flag (XFC) is "0" at timing t1, the CPU 24 determines NO at step 103 and terminates this routine. The operations of steps 101 through 103 are repeatedly carried out until the engine speed (NE) reaches closely to the first determining value (Da).

While the engine speed (NE) is increasing, the positive torque is acting on the torsional dampers 32. Then, the dampers 32 are swerved or twisted, and the engine drive shaft is kept at the maximum displaced position (PA) on accelerating the vehicle. At the same time, the torsional dampers 32 accumulate the repulsion force which pushes back the engine drive shaft toward the neutral position. The repulsion force tends to restrain the revolution of the engine drive shaft.

As the engine speed (NE) further increases and exceeds the first determining value (Da) at timing t2, the CPU 24 determines YES at step 102. Then, the CPU 24 sets the flag (XFC) to "1" (step 104). The CPU 24 transmits the signal to injectors 8A through 8D, which instructs the forcible halt operation of fuel injection (step 105). Thus, the CPU 24 forcibly halts the fuel injections, and then terminates this routine.

There exists a time lag, which corresponds to the period of time until the fuel cut-off signal is transmitted since the CPU 24 read the engine speed (NE). This time lag is originated in the operational time or operation cycle of the CPU 24. Therefore, a small delay time is generated till the fuel cut-off operation is actually carried out after the engine speed (NE) has exceeded the first determining value (Da). In other words, the CPU 24 transmits a fuel cut-off signal at timing t3 when the predetermined delay time At has elapsed since the timing t2. During the time period (between timing t2 through timing t3), the engine speed (NE) continuously increases and overshoots the first determining value (Da).

Performing the fuel cut-off operation causes the positive torque acting on the torsional dampers 32 to be inverted to the negative torque by the action of the dampers 32. Then, the drive shaft of the engine 1 is shifted to the neutral position. In that case, the engine speed (NE) rapidly drops by the repulsion force accumulated in the dampers 32, in addition to the normal power dropping of the engine originated in the fuel cut-off operation.

When the engine speed (NE) drops below the first determining value (Da) at timing t4, due to the above-described rapid dropping, the CPU 24 determines NO at step 102. Since the flag (XFC) has been set to "1" at timing t3, the CPU 24 determines YES at step 103 and then transfers the operation to step 106.

The CPU 24 determines whether the engine speed (NE) exceeds the second determining value (Db) (i.e., 6600 r.p.m.) (step 106). Since the engine speed (NE) is larger than the second determining value (Db) at timing t4, the CPU 24 determines YES at step 106. Then, the CPU 24 determines whether the fuel cut-off operation is being carried out (step 107). As the fuel cut-off signal has been transmitted at timing t3, the CPU 24 determines YES at step 107. The CPU 24 transmits a signal to instruct the termination of fuel cut-off operation (i.e., resumption of fuel supply) (step 1.08), and terminates this routine. Thus, the normal fuel injection control is resumed.

Similar to the above-description, there exists the delay time at until the fuel cut-off instruction signal is transmitted since the CPU 24 read the engine speed (NE). Therefore, the CPU 24 transmits an instructional signal for resuming the fuel injection operation at timing t5 when the delay time At has elapsed since timing t4. During its time period between timing t4 and t5, the engine speed (NE) continuously drops.

Resuming the fuel injection causes the negative torque acting on the torsional dampers 32 to be inverted to the positive torque. Then, the drive shaft of the engine 1 is shifted toward the first maximum displaced position (PA). When the direction of torque is reversed, the torsional dampers 32 are little swerved and the engine drive shaft is located at the neutral position. In other words, the dampers 32 have not accumulated any repulsion force which causes the engine drive shaft to shift with respect to the propeller shaft. Therefore, the engine speed (NE) is increased, merely due to the resumption of fuel injection, without being influenced by the repulsion force of the dampers 32.

The successive cycle is initiated, at timing t6 when the predetermined period of time (i.e., sixteen milliseconds) has elapsed since the timing t5. Then, the CPU 24 determines NO at step 102, YES at step 103 and YES at step 106. As the fuel cut-off operation is halted at timing t5, the CPU 24 determines NO at step 107. The CPU 24 transmits a signal for executing the fuel cut-off operation (step 105), and then terminates this routine.

The positive torque acting on the dampers 32 is inverted to the negative torque due to the resumption of fuel cut-off operation. The drive shaft of the engine 1 is shifted toward the neutral position. At this time, the dampers 32 are little swerved, and the engine drive shaft is located at the neutral position. In other words, the dampers 32 have little accumulated repulsion force which causes the engine drive shaft to shift. The engine speed (NE) deceases, merely due to fuel cut-off, without any influence originated in the repulsion force of the dampers 32.

When the successive cycle is initiated at timing t7 in which the predetermined period of time (i.e., sixteen millisecond) has elapsed since the timing t6, the CPU 24 determines NO at step 102, YES at step 103 and YES at step 106. Further, the CPU 24 determines YES at step 107, due to the fuel cut-off condition at timing t6. The CPU 24 transmits an instruction signal to halt the fuel cut-off operation (step 108), and then terminates this routine.

The resumption of fuel injection causes the negative torque acting on the torsional dampers 32 to be inverted to the positive torque. Therefore, the drive shaft of the engine 1 is shifted toward the first maximum displaced position (PA). At this time, the dampers 32 are little swerved, and have not accumulated repulsion force which causes the engine drive shaft to shift. Accordingly, the engine speed (NE) increases, merely due to the resumption of fuel injection, without being influenced the repulsion force of the dampers 32.

Every time when the operation shown in FIG. 4 is carried out (i.e., every sixteen milliseconds), the operations of the fuel cut-off and the resumption of fuel supply are alternately carried out. Thus, the engine drive shaft can be steadily positioned at the vicinity of the neutral position, because of the repeated execution of fuel supply/cut-off at a short cycle.

When the magnitude of thrusting the accelerator pedal is eased while the engine speed is in a stable condition, the engine speed (NE) is deceased and becomes smaller than the second determining value (Db) at timing t8. The CPU 24 then determines NO at step 102, YES at step 103, and NO at step 106. The CPU 24 reads a throttle angle (TA) detected by the throttle sensor 17 (step 109), and determines whether the throttle angle (TA) is smaller than the predetermined angle (i.e., 30°) (step 110). When the throttle angle (TA) is smaller than 30°, the CPU 24 sets the flag (XFC) to "0" from "1" (step 111). After these operations, the CPU 24 halts the fuel cut-off operation (step 108), and terminates this routine. Actually, the flag (XFC) is set to "0" at timing t9 when the delay time Δt has elapsed since the engine speed (NE) became equal to or smaller than the second determining value (Db), due to the time lag originated in computing period. The suspension of fuel cut-off causes the conventional, regular fuel injection control to resume.

when the throttle angle (TA) is equal to or larger than 30° at step 110, the CPU 24 halts the fuel cut-off operation at step 108, without setting the flag.

According to this embodiment, when the engine speed (NE) exceeds the first determining value (Da) for fuel injection halt, the fuel supply by the injectors 8A through 8D is suspended (steps 102, 104 and 105). On the other hand, when the engine speed (NE) drops below the second determining value (Db) for fuel injection resume, the fuel injection is resumed (steps 106,111 and 108). Further, when the engine speed (NE) drops due to the halt of fuel injection and becomes smaller than the first determining value (Da), a set of resume and halt operations of fuel injection is executed at least once (i.e., once or more than twice) (steps 103, 106, 107, 105 and 108). Therefore, the drive shaft of the engine 1 is kept approximately at the neutral position, by repeating the execution and termination of fuel cut-off operation at a rather short cycle (i.e., sixteen milliseconds).

According to the conventional arts, the fuel cut-off status is kept during the period of time till the engine speed drops below the value (Db) from the halt of fuel supply. Accordingly, the drive shaft of the engine 1 is displaced from the first maximum displaced position (PA) during acceleration to the second maximum displaced position (PB) during deceleration. As a result, a large magnitude of repulsion force is accumulated in the torsional dampers. On the contrary, according to this embodiment, the direction of the torque acting on the torsional dampers 32 is reversed, before the engine drive shaft reaches either the first or second maximum displaced positions (PA or PB). This reversion causes the repulsion force accumulated in the dampers 32 to be reduced. Accordingly, the repulsion force of the dampers 32 hardly influences the engine speed (NE). When the fuel supply/cut-off control is executed, the fluctuation of engine speed (NE) therefore becomes marginal. The impact originated in the fluctuation also becomes substantially reduced.

According to the conventional art, the engine speed greatly overshoots the first determining value (Da), as the fluctuation of engine speed is substantially large under the fuel supply/cut-off control. In order to prevent the engine overrunning (i.e., exceeding an allowable maximum engine speed), the first determining value (Da) for injection halt should be set to a relatively small value. On the contrary, according to this embodiment, the fluctuation of engine speed is marginal under the fuel injection control mode, and the engine speed (NE) is therefore converged to a value lying between the first and second determining value (Da and Db). Consequently, the first determining value (Da) can be set to a rather higher value than that of the conventional art.

According to this embodiment, even when the fuel injection control is executed, an exhaust air-fuel ratio (A/F) is kept at lean conditions, and the over-heating of catalyst can be prevented. In the conventional arts, a large magnitude of engine speed fluctuation is generated in the fuel supply/cut-off control. Such the large fluctuation of engine speed is equivalent to driving a vehicle with a large rate in the acceleration or deceleration. Therefore, the conventional arts requires a large amount of fuel (i.e., long injection time), in order to maintain a certain constant engine speed. As a result, the fuel consumption in the fuel supply/cut-off control operation is lowered in comparison to that in the stable driving state where the fluctuation of the engine speed is marginal.

Figure 5A:
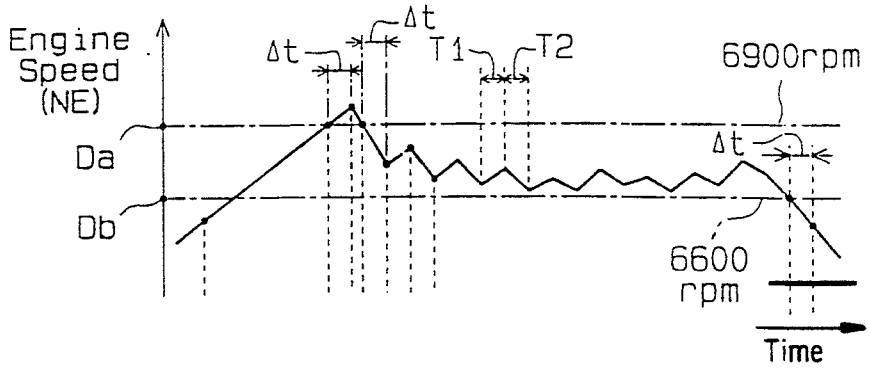
FIGS. 5A, 5B, 5C and 5D are a timing chart showing the correlation among engine speed, flag (XFC) as a fuel cut-off indicator, the condition of the fuel cut-off operation and the displacement of the engine drive shaft, with respect to time.
Figure 5B:
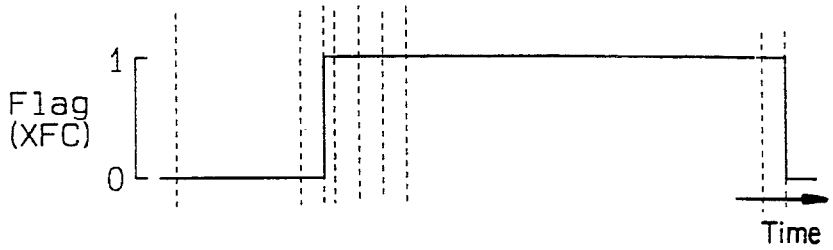
Figure 5C:
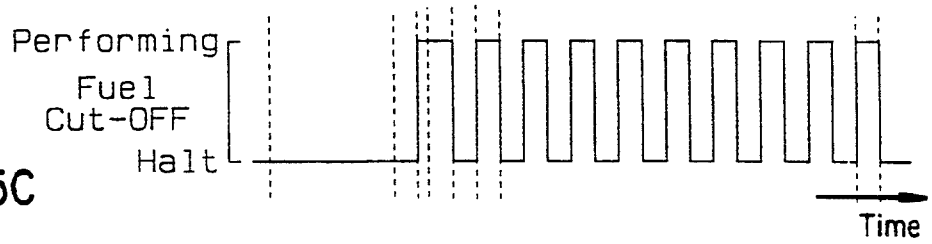
Figure 5D:
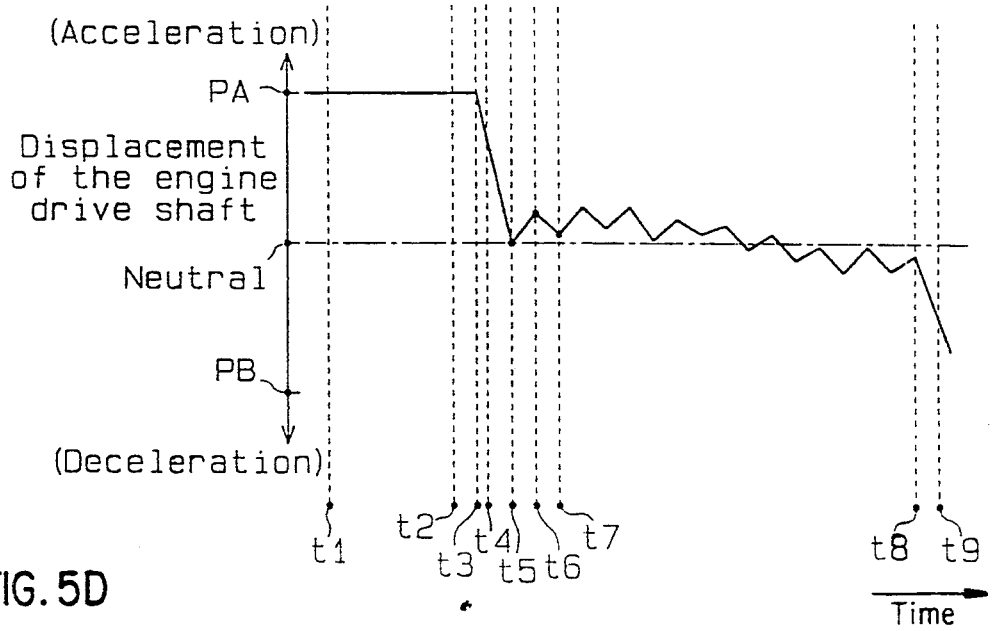
Figure 12A:
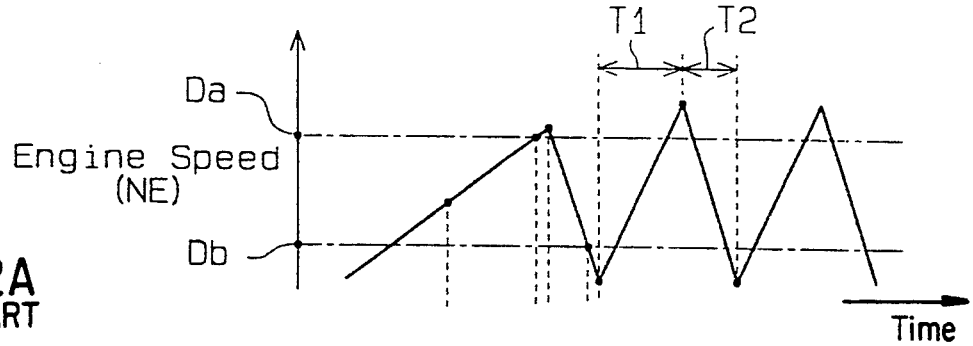
FIG.12A PRIOR ART
FIGS. 12A, 12B and 12C is a timing chart showing the correlation among engine speed, the condition of the fuel cut-off operation and the displacement of the drive shaft, with respect to time, in the conventional art.
Figure 12B:
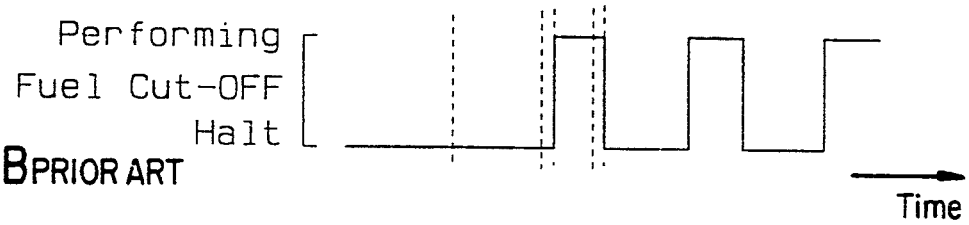
FIG.12B PRIOR ART
Figure 12C:
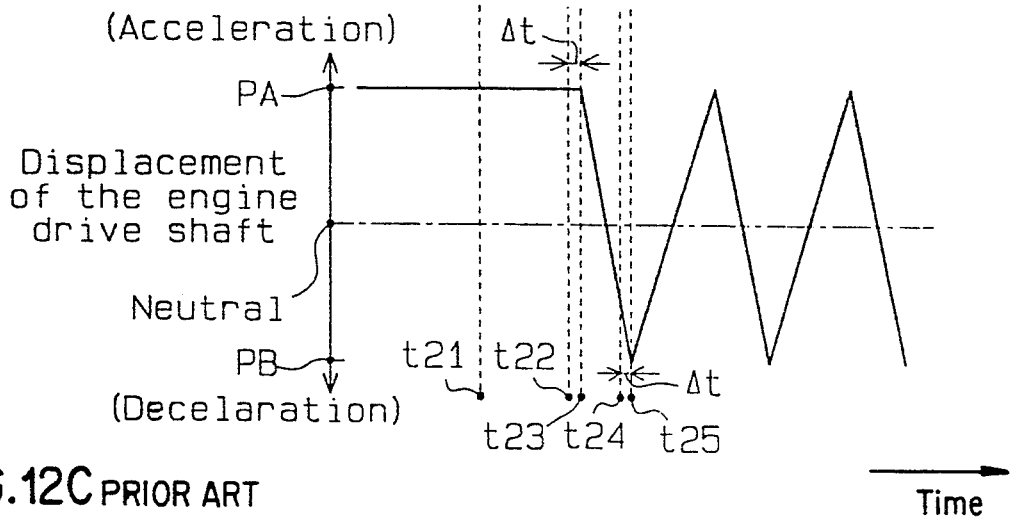
FIG.12C PRIOR ART

The present invention will be further compared with the conventional arts. FIGS. 5A and 12A show engine speed increasing time (T1) and engine speed decreasing time (T2). The engine speed increasing time (T1) is a period of time which is required to increase the engine speed by a certain number of revolutions, originated from the resumption of fuel injection. The engine speed decreasing time (T2) is a period of time which is required to decrease the engine speed by the certain number of revolutions, originated from the fuel cut-off operation. In this embodiment shown in FIG. 5A, the increasing time (T1) is equal to the decreasing time (T2). However, in the conventional art shown in FIGS. 12A, 12B and 12C, the increasing time (T1) is longer than the decreasing time (T2). The reason for such difference will now be considered below.

Vehicular inertial mass is constant, regardless of the increase or decrease of engine speed. However, when a vehicle is running, the vehicle suffers running resistance (i.e., mainly air resistance). As the engine speed increases, the air resistance increases. When the vehicle is accelerating, the air resistance acts as a force for restraining the increase of engine speed. On the contrary, when the vehicle is decelerating due to the fuel cut-off operation, the air resistance promotes the decrease of engine speed. Therefore, the speed increasing time (T1) becomes longer than the speed decreasing time (T2).

On the contrary, according to this embodiment, the fuel cut-off and fuel supply resumption are repeatedly carried out by the predetermined cycle interval (i.e., sixteen milliseconds). Accordingly, the increasing time (T1) becomes equal to the decreasing time (T2), in this embodiment as shown in FIG. 5A. Further, the fluctuation of engine speed (NE) in this embodiment is smaller than that in the conventional art, and the engine speed becomes closer to a stable condition. The amount of fuel required to maintain a predetermined engine speed in this embodiment becomes much less than that required in the conventional art. Therefore, an exhaust air-fuel ratio (A/F) in this embodiment becomes substantially leaner condition than that of the conventional art, under the fuel cut-off operation.

The case, where the fuel supply is shut off to the engine which is running under the condition of A/F=12, will now be considered. The fuel-air mixture is supplied to the engine during the increasing time (T1). On the other hand, only the air is supplied to the engine during the decreasing time (T2). Therefore, the exhaust air-fuel ratio $(A/F)_{cut}$ in the fuel cut-off operation can be estimated by the following equation, according to the relationship between the time (T1) and (T2).

$$(A/F)_{cut}=(A/F)\cdot\{(T1+T2)/T1\}$$

T1/T2=1/1 according to the result of this embodiment shown in FIG. 5A; T1/T2=2/1 according to the result of the conventional art shown in FIG. 12A.

$$(A/F)_{cut}\text{ (conventional art)}=12\cdot\{(2+1)/2\}=18$$

$$(A/F)_{cut}\text{ (this embodiment)}=12\{(1+1)/1\}=24$$

Apparently from the above computation, the $(A/F)_{cut}$ of this embodiment becomes leaner than that of the conventional art. That is equivalent to introducing excessive secondary air into the exhaust passage 3.

Figure 6:
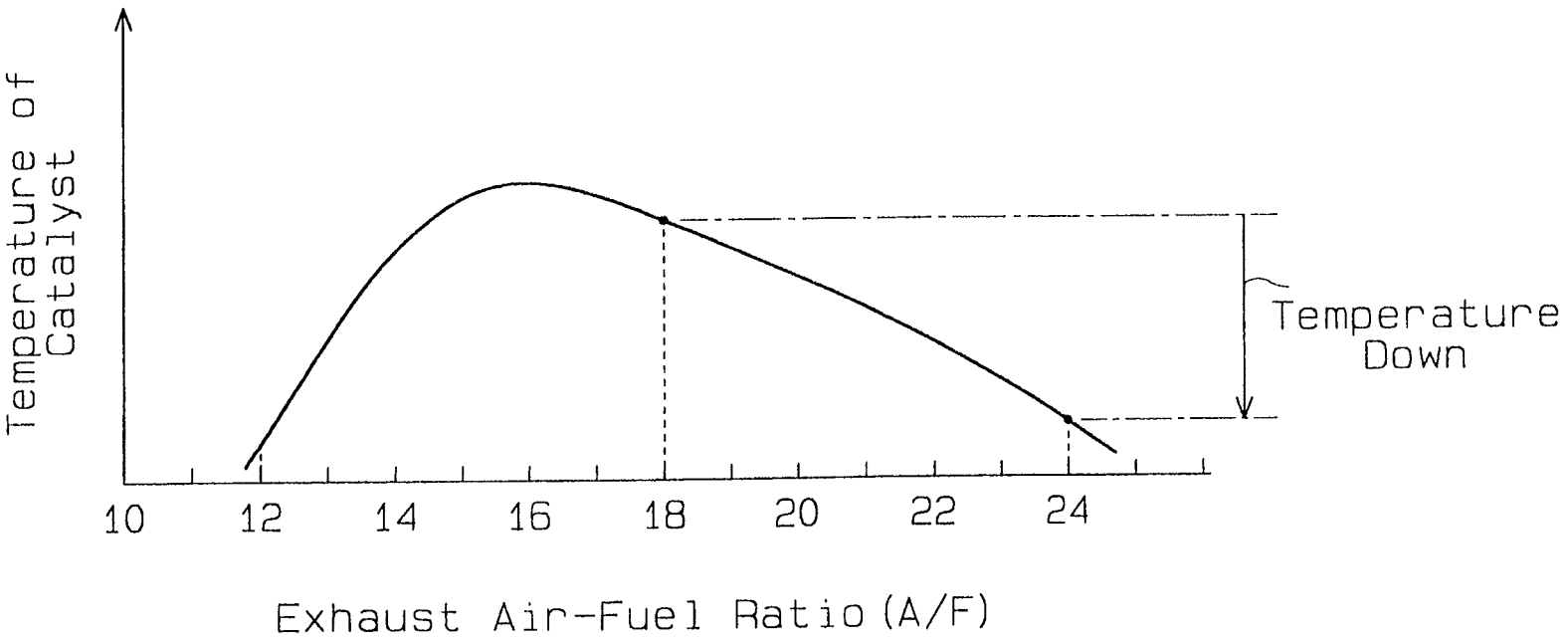

Furthermore, apparent from FIG. 6, in the case of (A/F=12), unburned substance remains in the exhaust passage. In the case of (A/F=18), as the excessive air corresponding to the secondary air is introduced, unburned substance is burned in the catalytic converter 14. The burning of the unburned substance causes the catalytic temperature to be increased. In the case of (A/F=24), the air to be supplied to the converter 14 is more excessive than that in the case of (A/F =18). The more excessive air cools the catalyst down, such that the catalytic temperature is lowered. Therefore, overheating of the catalyst is effectively prevented in this embodiment.

Second Embodiment

In the first embodiment, as the fluctuation of engine speed is marginal, an impact caused by the fuel cut-off operation is significantly reduced. Therefore, a driver may not notice that the fuel cut-off operation is carried out for preventing the overrunning of the engine. This second embodiment discloses a modification which enable the driver to notice the execution of the fuel cut-off operation.

Figure 9:
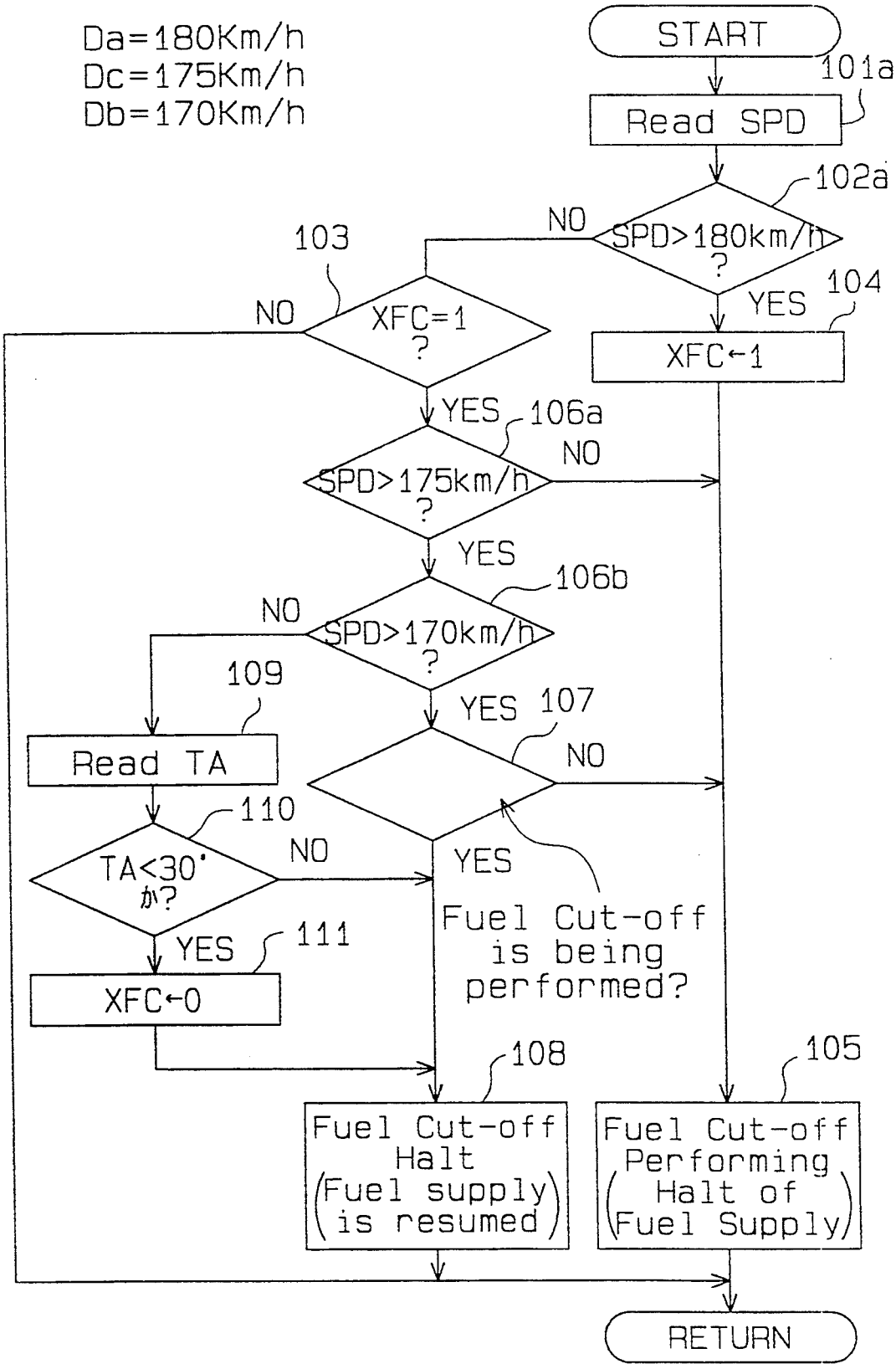
Figure 10A:
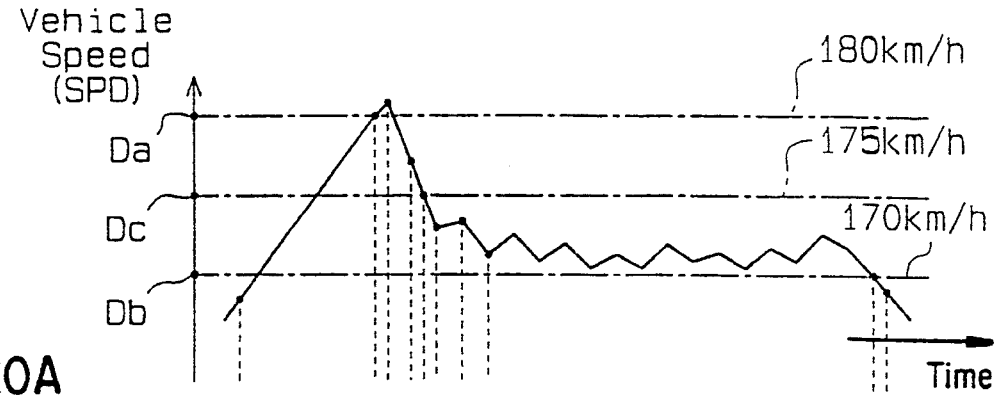
FIGS. 10A, 10B, 10C and 10D is a timing chart showing the correlation among vehicle speed (SPD), flag (XFC) as a fuel cut-off indicator, the condition of the fuel cut-off operation and the displacement of the engine drive shaft, with respect to time.
Figure 10B:
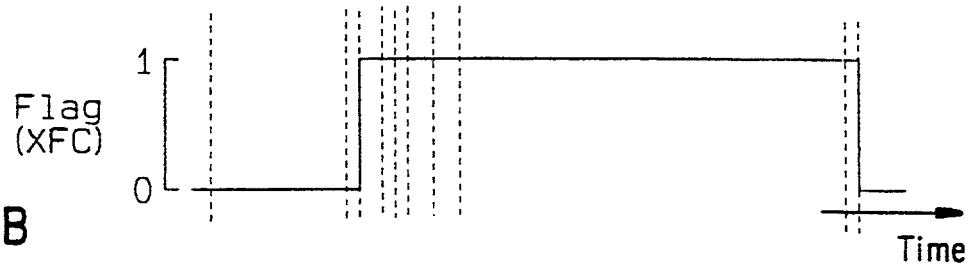
Figure 10C:
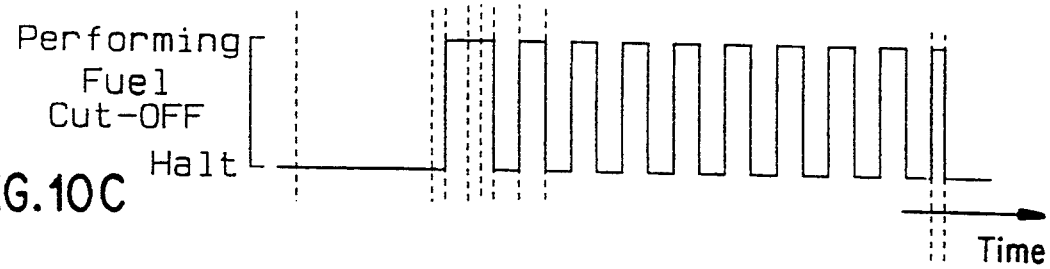
Figure 10D:
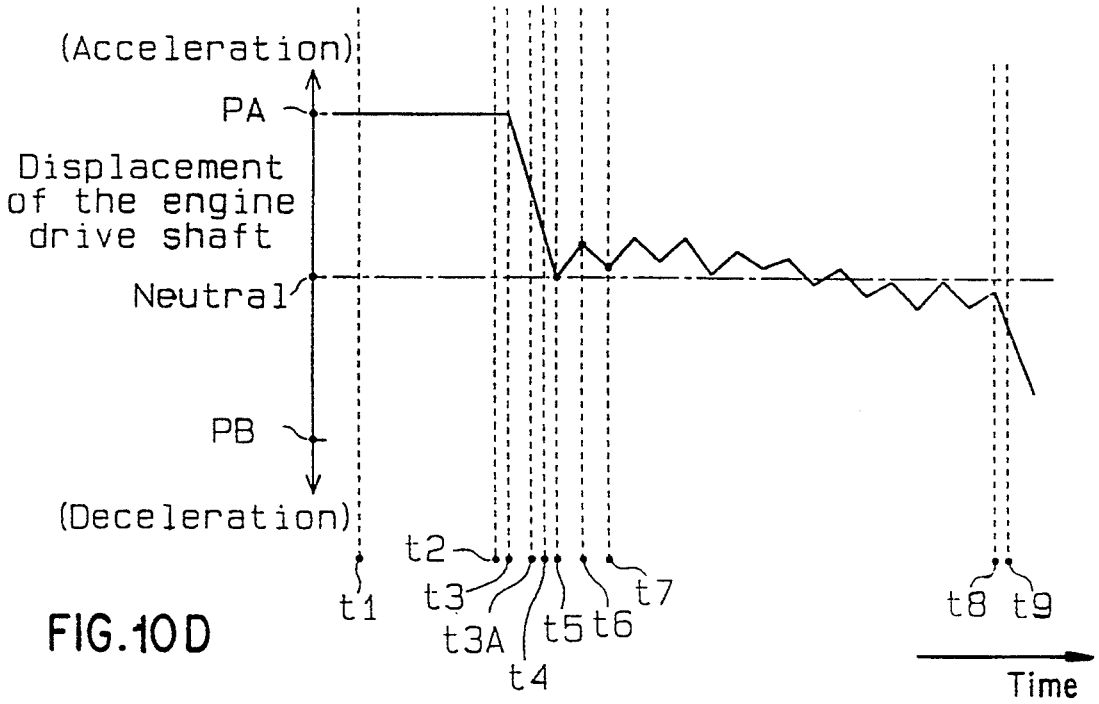
Figure 11:
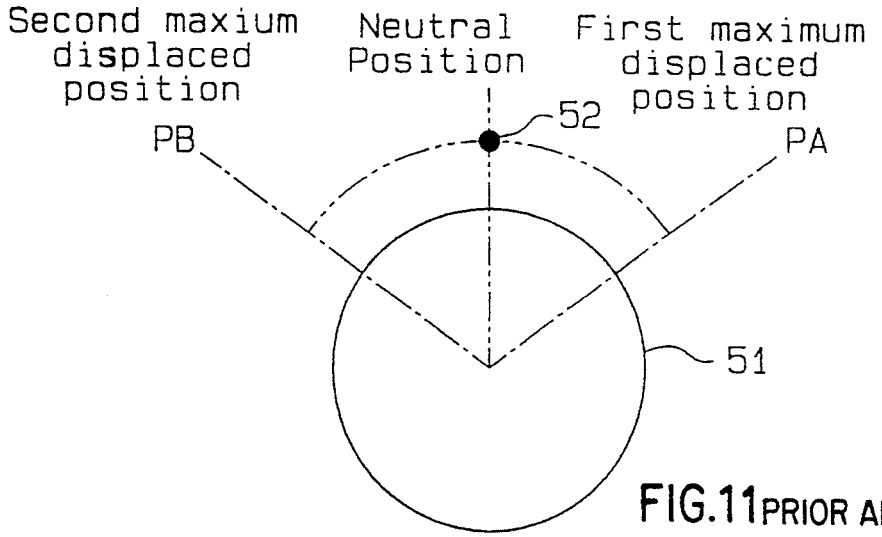
FIG.11 PRIOR ART
FIG. 11 is a drawing which conceptionally describes the displacement of the engine drive shaft with respect to the propeller shaft.

The second embodiment according to the present invention will now be described referring to FIGS. 7 and 8A, 8B, 8C and 8D. FIGS. 8A, 8B, 8C and 8D shows a routine for the fuel cut-off control, which corresponds to FIG. 4 according to the first embodiment. FIG. 9 shows a flow chart, which corresponds to FIGS. 5A, 5B, 5C and 5D according to the first embodiment.

According to the second embodiment, an intermediate determining value (Dc) is provided, which is lying between the first and second determining values (Da and Db). When the engine speed becomes equal to or below the intermediate value (Dc) from the value (Da) (i.e., fuel injection halt condition), the resume and halt operations of fuel injection will be carried out. The first determining value (Da) for fuel injection halt is set to 6900 r.p.m., the second determining value (Db) for fuel injection resume to 6500 r.p.m., and the intermediate value (Dc) to 6700 r.p.m., respectively.

Figure 7:
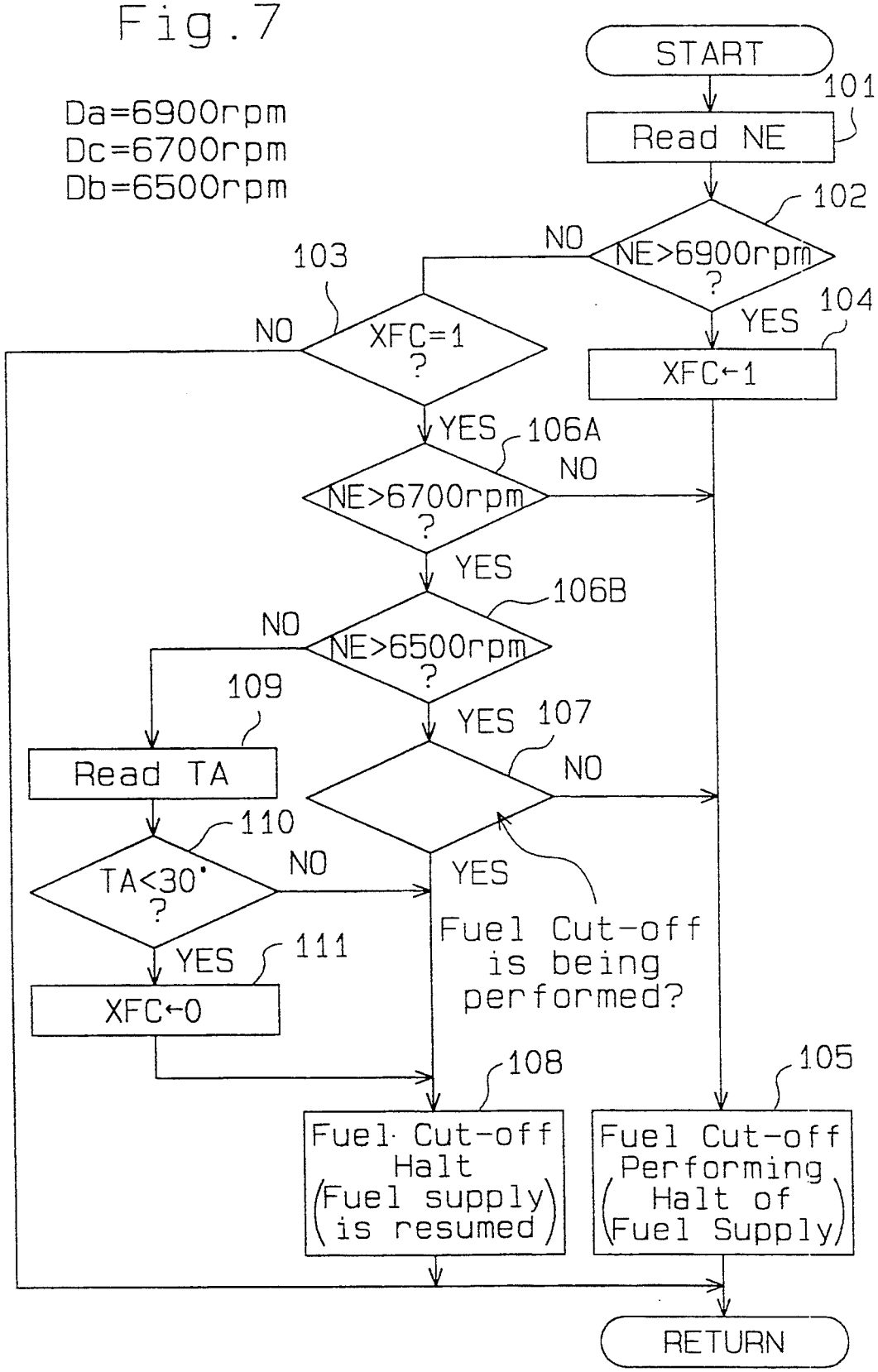
Figure 8A:
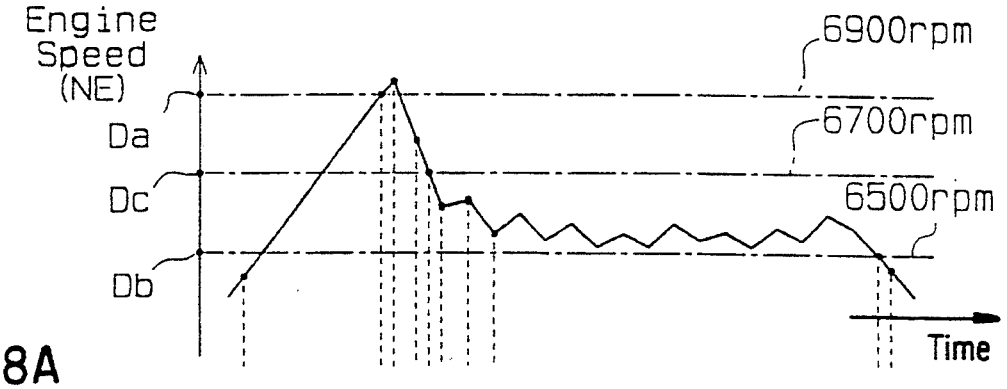
FIGS. 8A, 8B, 8C and 8D are a timing chart showing the correlation among engine speed, flag (XFC) as a fuel cut-off indicator, the condition of the fuel cut-off operation and the displacement of the engine drive shaft, with respect to time.
Figure 8B:
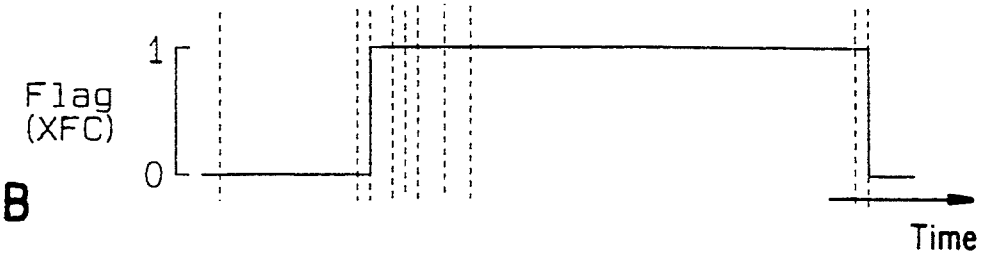
Figure 8C:
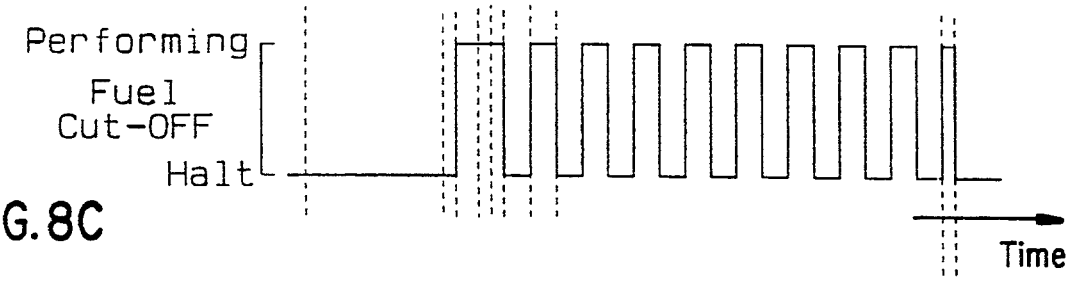
Figure 8D:
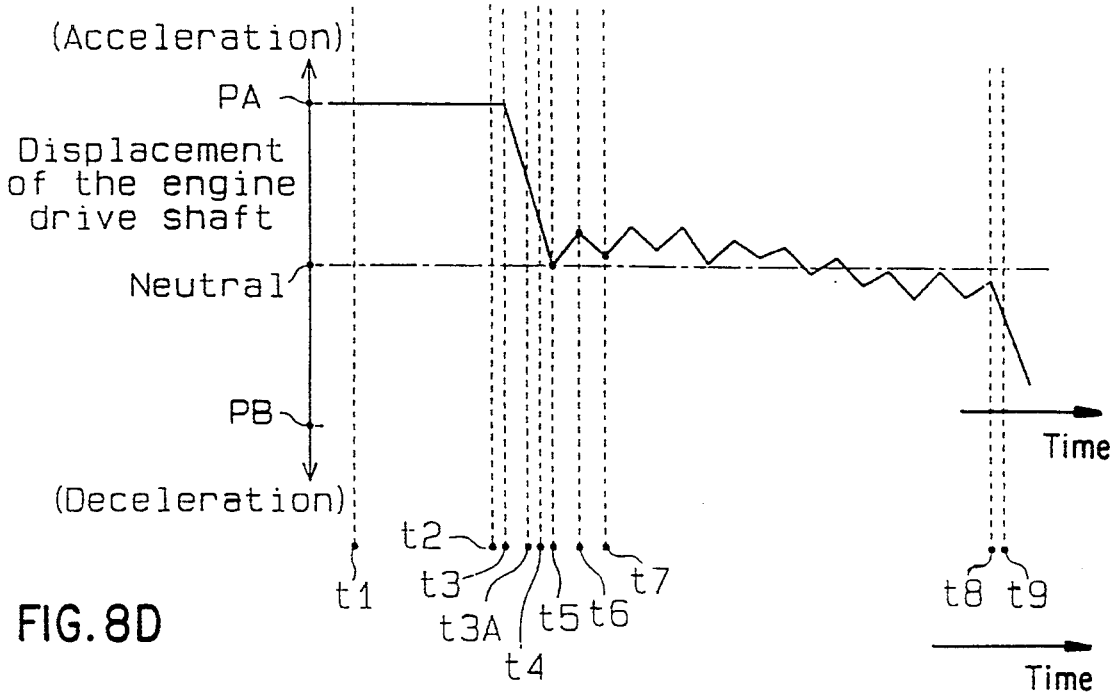

FIG. 7 shows the determinations at steps 106A and 106B which take the place of the determination at step 106 in FIG. 4. The CPU 24 determines whether the engine speed (NE) is below the intermediate value (Dc)

at step 106A, and whether the engine speed (NE) is greater than the second value (Db) at step 106B.

When the fuel cut-off operation is carried out at timing t3 in FIG. 8, the engine speed (NE) is decreased. When the engine speed (NE) is to be lying between the first determining value (Da) and the intermediate value (Dc) at timing t3A (Dc <NE<Da), the CPU 24 determines "NO" at step 102 of FIG. 7, "YES" at step 103, and "NO" at step 106A. The CPU 24 transmits a signal to instruct a fuel cut-off operation (step 105). The continuance of the fuel cut-off operation causes the engine speed (NE) to be further decreased.

When the engine speed (NE) is to be lying between the second determining value (Db) and the intermediate value (Dc) at timing t4 (Db<NE<Dc), the CPU 24 advances its execution to step 107. Then, the execution and halt of fuel cut-off are alternately repeatedly carries out by a short cycle, in the same manner as the first embodiment.

According to the second embodiment, the fuel cut-off operation is continued until the engine speed (NE) drops below the intermediate value (Dc), even when the engine speed (NE) drops below the first determining value (Da). Accordingly, there exists a large difference between the engine speed (NE) at timing t3 and that at timing t5 when the fuel supply is resumed. Such the large difference produces an impact caused by the fuel cut-off operation, the magnitude of which is large enough for the driver to notice the execution of the fuel cut-off operation.

The manner in this embodiment generates a rather large fluctuation of the engine speed when the first fuel cut-off operation has been performed just after the engine speed exceeded the first determining value (Da). Therefore, the driver can notice the fuel cut-off operation is carried out, due to the large fluctuation of the engine speed. Further, the second embodiment can achieve the same operations and effectiveness as those which the first embodiment has accomplished.

Third Embodiment

The third embodiment according to the present invention will now be described referring to FIGS. 9 and 10A, 10B, 10C and 10D. FIG. 9 shows a routine for the fuel cut-off control, which corresponds to FIG. 7 of the second embodiment. FIGS. 10A, 10B, 10C and 10D shows a timing chart which corresponds to FIGS. 8A, 8B, 8C and 8D of the second embodiment.

In the third embodiment, a vehicle speed (SPD) detected by means of the vehicle speed sensor 22 is utilized in the place of the engine speed (NE), unlike the second embodiment. Accordingly, the first determining value (Da) for fuel injection halt is set to 180 km/hr, the second determining value (Db) for fuel injection resume to 170 km/hr, and the intermediate value (Dc) to 175 km/hr. The CPU 24 reads a vehicle speed (SPD) at step 101*a* in FIG. 9. The CPU 24 determines whether the vehicle speed (SPD) is greater than the first determining value (Da=180 km/hr) at step 102*a*, whether the vehicle speed (SPD) is smaller than the intermediate value (Dc=175 km/hr) at step 106*a*, and whether the vehicle speed (SPD) is greater than the second determining value (Db=170 km/hr) at step 106*b*.

According to the third embodiment, repulsion force accumulated in the torsional dampers 32 is decreased, like the first and second embodiments. Therefore, the fluctuation in the vehicle speed under the fuel supply/-cut-oil control becomes small, thereby accomplishing the smooth driving. In this embodiment, the intermediate value (Dc=175 km/hr) is prepared, like the second embodiment. Accordingly, the driver can notice that the fuel cut-off operation is carried out, based on a large fluctuation of engine speed which is caused by the first fuel cut-off just after the vehicle speed exceeded the first determining value (Da).

Although only three embodiments of the present invention have been described herein, it should be apparent to those skilled in the art that the present invention may be embodied in many other specific forms, without departing from the spirit or scope of the invention. Particularly, it should be understood that the following modifications are allowed.

The first and second determining values (Da and Db) and the intermediate determining value (Dc) may be preferably altered in accordance with the type or size of an engine.

An interval of interruption request for the fuel supply/cut-off control routine can be preferably altered. However, the shorter the interval of interrupt request is, the more preferable it is. According to experimentation, the interval should be less than 20 milliseconds.

In the above-described embodiments, the operations of fuel injection resume and halt are repeatedly carried out, when the engine speed (NE) or vehicle speed (SPD) becomes below the determining value (Da) or (Dc), from a larger value than the first determining value (Da). The executed number of the operations of fuel injection resume and halt can be once or a few times, according to engine condition.

Therefore, the present examples and embodiments are to be considered as illustrative and not restrictive and the invention is not to be limited to the details giving herein, but may be modified within the scope of the appended claims.

What is claimed is:

1. An engine speed controller for a vehicle, which includes an engine with a drive shaft; an injector for supplying fuel to the engine; a driving wheel; a propeller shaft connected to the driving wheel; and a flexible torsional member for connecting the propeller shaft with the engine drive shaft to relieve a torque impact caused by engine acceleration or deceleration, the engine speed controller comprising:

detection means for detecting a value corresponding to engine speed, and for outputting the detected value; and injection control means for controlling the injector, based on the detected value from said detection means, such that the engine speed is kept constant while preventing overrunning of the engine, wherein said injection control means includes:

A) data storage means for storing a first determining value (Da) for the halt of fuel injection, and a second determining value (Db) for the resumption of fuel injection;

B) primary control means for halting fuel supply from the injector when the detected value exceeds the first determining value (Da), and for resuming fuel supply from the injector when the detected value becomes below the second determining value (Db); and C) secondary control means for causing the injector to execute the resumption and halt of fuel injection at least one time, when the detected value is changed to a smaller value than the first value (Da) from a larger value than the first value (Da), thereby extinguishing the torsional energy accumulated in the torsional member.

2. The controller according to claim 1, wherein said detection means includes an engine speed sensor, and said value corresponding to engine speed is the number of revolutions of the engine itself.

3. The controller according to claim 1, wherein said injection control means includes an electronic control unit (ECU) comprising a central processing unit (CPU), a read only memory (ROM) and a random access memory (RAM).

4. The controller according to claim 1, wherein the torsional member is a torsional damper.

5. The controller according to claim 4, wherein said torsional damper allows the engine drive shaft to be positioned from a neutral position to a first maximum displaced position (PA) with respect to the propeller shaft, on accelerating the vehicle, and to be positioned from the neutral position to a second maximum displaced position (PB) with respect to the propeller shaft, on decelerating the vehicle.

6. An engine speed controller for a vehicle, which includes an engine with a drive shaft; an injector for supplying fuel to the engine; a driving wheel; a propeller shaft connected to the driving wheel; and a flexible torsional member for connecting the propeller shaft with the engine drive shaft to relieve a torque impact caused by engine acceleration or deceleration, the engine speed controller comprising:

detection means for detecting a value corresponding to engine speed, and for outputting the detected value; and injection control means for controlling the injector, based on the detected value from said detection means, such that the engine speed is kept constant while preventing overrunning of the engine, wherein said injection control means includes:

A) data storage means for storing a first determining value (Da) for the halt of fuel injection, a second determining value (Db) for the resumption of fuel injection, and a third determining value (Dc) set between the first and second determining values (Da and Db);

B) primary control means for halting fuel supply from the injector when the detected value exceeds the first determining value (Da), and for resuming fuel supply from the injector when the detected value becomes below the second determining value (Db); and C) secondary control means for causing the injector to execute the resumption and halt of fuel injection at least one time, when the detected value is changed to a smaller value than the third value (Dc) from a larger value than the first value (Da), thereby extinguishing the torsional energy accumulated in the torsional member.

7. The controller according to claim 6, wherein said detection means includes an engine speed sensor, and said value corresponding to engine speed is the number of revolutions of the engine itself.

8. The controller according to claim 6, wherein said detection means includes a vehicle speed sensor, and said value corresponding to engine speed is the velocity of the vehicle.

9. The controller according to claim 6, wherein said injection control means includes an electronic control unit (ECU) comprising a central processing unit (CPU), a read only memory (ROM) and a random access memory (RAM).

10. The controller according to claim 6, wherein the torsional member is a torsional damper.

11. The controller according to claim 10, wherein said torsional damper allows the engine drive shaft to be positioned from a neutral position to a first maximum displaced position (PA) with respect to the propeller shaft, on accelerating the vehicle, and to be positioned from the neutral position to a second maximum displaced position (PB) with respect to the propeller shaft, on decelerating the vehicle.

* * * * *